US007134380B2

(12) United States Patent
Nielsen et al.

(10) Patent No.: US 7,134,380 B2
(45) Date of Patent: Nov. 14, 2006

(54) VALVE ARRANGEMENT AND HYDRAULIC DRIVE

(75) Inventors: Brian Nielsen, Soenderborg (DK); Poul Erik Hansen, Gjern (DK); Torben Ole Andersen, Aalborg (DK)

(73) Assignee: Sauer-Danfoss ApS, Nordborg (DK)

( * ) Notice: Subject to any disclaimer, the term of this patent is extended or adjusted under 35 U.S.C. 154(b) by 31 days.

(21) Appl. No.: 10/930,415

(22) Filed: Aug. 31, 2004

(65) Prior Publication Data

US 2005/0051026 A1 Mar. 10, 2005

(30) Foreign Application Priority Data

Sep. 3, 2003 (DE) ..... 103 40 506

(51) Int. Cl.
*F15B 13/04* (2006.01)

(52) U.S. Cl. ..... 91/455; 91/444

(58) Field of Classification Search ..... 91/444, 91/454, 455, 464

See application file for complete search history.

(56) References Cited

U.S. PATENT DOCUMENTS

| | | | | |
|---|---|---|---|---|
| 4,206,688 | A * | 6/1980 | Haak et al. | 91/454 |
| 4,572,238 | A * | 2/1986 | Stenlund | 91/455 |
| 4,840,111 | A | 6/1989 | Garnjost | |
| 5,097,746 | A * | 3/1992 | Asaoka et al. | 91/454 |
| 5,138,838 | A | 8/1992 | Crosser | |
| 5,568,759 | A | 10/1996 | Aardema | |
| 5,746,108 | A * | 5/1998 | Kim | 91/444 |
| 5,960,695 | A | 10/1999 | Aardema et al. | |
| 6,131,391 | A * | 10/2000 | Poorman | 91/454 |
| 6,293,181 | B1 * | 9/2001 | Hajek et al. | 91/464 |
| 6,354,185 | B1 * | 3/2002 | Sturman | 91/454 |
| 6,467,264 | B1 | 10/2002 | Stephenson et al. | |
| 6,609,369 | B1 | 8/2003 | Koehler et al. | 60/459 |
| 6,789,570 | B1 * | 9/2004 | Beyrak et al. | 137/554 |
| 6,938,413 | B1 | 9/2005 | Harnischfeger | 60/413 |

FOREIGN PATENT DOCUMENTS

| | | |
|---|---|---|
| DE | 41 19 333 | 12/1992 |
| DE | 43 15 626 | 7/1994 |
| DE | 43 13 250 | 10/1994 |
| DE | 101 33 616 A1 | 7/2001 |
| DE | 102 45 346 A1 | 9/2002 |
| DE | 101 20 996 | 10/2002 |
| DE | 101 50 768 | 4/2003 |
| WO | WO 96/27051 | 9/1996 |

* cited by examiner

*Primary Examiner*—Edward K. Look
*Assistant Examiner*—Michael Leslie
(74) *Attorney, Agent, or Firm*—McCormick, Paulding & Huber LLP

(57) ABSTRACT

The invention concerns a valve arrangement for controlling a hydraulic drive, the supply and the outflow of the hydraulic drive being separately controllable. It is endeavoured to improve the valve arrangement in such a manner that it is intrinsically tight, at the same time having a relatively simple design. For this purpose, a pump pipe and a tank pipe are connected with a first control valve, the first control valve being connected by separate pipes with a second control valve and a third control valve connected in parallel with the second control valve, the second control valve being connected with a first working connection of the hydraulic drive and the third control valve being connected with a second working connection of the hydraulic drive, backflow preventers for preventing the flow from the hydraulic drive in the direction of the tank being connected in parallel with the second control valve and/or the third control valve.

15 Claims, 2 Drawing Sheets

VALVE ARRANGEMENT AND HYDRAULIC DRIVE

CROSS-REFERENCE TO RELATED APPLICATIONS

This application is entitled to the benefit of and incorporates by reference essential subject matter disclosed in German Patent Application No. 103 40 506.2 filed on Sep. 3, 2003.

FIELD OF THE INVENTION

The invention concerns a valve arrangement for controlling a hydraulic drive, the supply and the outflow of the hydraulic drive being separately controllable. Further, the invention concerns a hydraulic drive, which is controllable by means of a valve arrangement.

BACKGROUND OF THE INVENTION

From the general state of the art, valve arrangements for controlling hydraulic drives are known, in which the control openings for controlling the supply and the outflow of the hydraulic drive are mechanically or hydraulically connected with each other. However, such valve arrangements have the disadvantage that they have a poor energetic efficiency. Further, to avoid cavitation, a plurality of valves will be required, depending on the effective direction of a load acting upon the hydraulic drive, which makes the complete valve arrangement effort demanding and expensive. As a solution to this problem, EP 0 809 737 B1, U.S. Pat. No. 5,138,838, U.S. Pat. Nos. 5,568,759 and 5,960,695 suggest valve arrangements, with which the supply and the outflow of the hydraulic drive can be controlled separately. These solutions, however, do not meet the heavy requirements with regard to low leakage flows of the working connections, when the valves are not activated. With these valve arrangements, the undesirable leakage flows at the working connections can only be avoided by means of at least two bi-directional or more than four unidirectional electromechanical valve drives, which increases the total costs of the valve arrangement and thus also the manufacturing costs.

The task of the invention is to improve the above-described valve arrangement in such a manner that it is intrinsically tight, and at the same time the valve arrangement shall have a relatively simple design.

SUMMARY OF THE INVENTION

The invention solves this task with a valve arrangement as mentioned in the introduction in that a pump pipe and a tank pipe are connected with a first control valve, the first control valve being connected by separate pipes with a second control valve and a third control valve connected in parallel with the second control valve, the second control valve being connected with a first working connection of the hydraulic drive and the third control valve being connected with a second working connection of the hydraulic drive, backflow preventers for preventing the flow from the hydraulic drive in the direction of the tank being connected in parallel with the second control valve and/or the third control valve.

When the hydraulic drive is to be maintained in its instant operating position, and the second and the third control valves are closed, the backflow preventers help ensuring that no hydraulic fluid can flow to the hydraulic drive or from the hydraulic drive. Thus, it is no longer required to provide a drive pressure favouring high leakage flow at the two working connections of the hydraulic drive to hold the hydraulic drive in its instant operating position. The low hydraulic pressure and the closed valves make the valve arrangement intrinsically tight when holding the hydraulic drive in its instant operating position. At the same time, the valve arrangement described is extremely simple and thus cost-effective in manufacturing. When knowing in advance, in which direction the load must be held, one single backflow preventer is sufficient, otherwise, two backflow preventers are used.

In a further embodiment of the invention, the backflow preventers, for example in the form of non-return valves, are integrated in the second control valve and in the third control valve. This will make the arrangement even simpler and thus more cost-effective in design.

Expediently, the supply to the hydraulic drive is controllable by the first control valve and the outflow from the hydraulic drive is controllable by the second control valve or the third control valve. This ensures a separate control of the supply and the outflow of the hydraulic drive. Further, the speed and the pressure level can be set separately.

Preferably, the first control valve is a 4/3-way valve, through which a connection of the pump pipe and the tank pipe with the two working connections, a connection of the second control valve with the third control valve and a connection of both the second control valve and the third control valve with the tank pipe can be realised. Consequently, the first control valve can control the supply amount to one of the two working connections. Further, the first control valve also provides a return path for the return flow of hydraulic fluid from the working connections. The return path of the first control valve also permits a sufficient hydraulic flow, so that a corresponding throttling of the second and the third control valves will ensure a very accurate control of the hydraulic drive. The first control valve is designed so that a return path is practically always available, independently of the instant valve position. Thus, in the pipe branches between the backflow preventers and the first control valve, a hydraulic pressure provided by the pump cannot be maintained, when the supply pressure provided by the pump is interrupted by the corresponding position of the first control valve. Then, merely the pressure acting in the pipe branches between the hydraulic drive and the backflow preventers acts upon the two backflow preventers, said pressure closing the backflow preventers in tank direction, so that the instant operating position of the hydraulic drive can be maintained without an available pump pressure. Thus, merely a minimum required pressure acts upon the working connections at the hydraulic drive, which prevents leakage flows at the working connections.

The second control valve and the third control valve can be 2/2-way valves, through which the outflow of the hydraulic drive is controlled. Depending on the position of the second and the third control valves, the outflow amount can be throttled. Thus, the task of the first control valve is to determine the supply direction and the outflow direction of the hydraulic drive. The second and the third control valves determine the outflow amount.

Preferably, the first control valve and/or the second control valve and/or the third control valve are adjustable directly and/or through a pressure control and/or through a directional control and/or through one or more pulse-width modulated control valves, for example one or more solenoid valves. Thus, the valve arrangement is particularly well suited for being programmed to certain operation modes.

In a preferred embodiment, a magnet and a spring can drive each control valve. Thus, when not activated, the control valves are switched to a preferred resting position. This resting position can, for example, ensure that the hydraulic drive is safely held in its instant position. Then, the outflow of the hydraulic drive through the second and the third control valves is blocked, and the pump pressure through the first control valve is interrupted. Preferably, the first control valve then provides a connection to the tank for the pipe branches between the two backflow preventers and the first control valve and for the pipe branches between the second and the third control valves, so that these pipe branches are without pressure.

Thus, it is expedient, that, in the resting position of the first control valve, the connection of the second control valve with the third control valve and the connection of both the second control valve and the third control valve with the tank pipe is ensured, and that, in the resting position of the second and the third control valves the outflow of the hydraulic drive is blocked.

Depending on certain operation modes of the valve arrangement, the second control valve and the third control valve can be activated separately or in common.

In a further embodiment of the invention, the valve arrangement has a first pressure sensor in the pump pipe, a second pressure sensor in the tank pipe, a third pressure sensor for measuring the pressure at the first working connection and a fourth pressure sensor for measuring the pressure at the second working connection. With the pressure sensors, the actual pressures of the individual pipe branches can be measured to control the control valves in accordance with preset desired pressures. The flow amount can also be determined by measuring a differential pressure by means of pressure sensors, and subsequently the flow amount can be calculated.

Alternatively to the first pressure sensor and to the second pressure sensor, a mechanical pressure compensator and a shuttle valve may be provided, the mechanical pressure compensator being integrated in the pump pipe and the shuttle valve being connected with the pipe section between the first control valve and the second control valve, with the pipe section between the first control valve and the third control valve and with the mechanical pressure compensator. The shuttle valve then leads the pressure from the supply pipe back to the mechanical pressure compensator. When using the mechanical pressure compensator and the shuttle valve, the supply becomes independent of the pressure ruling in the pump pipe and at the working connections. The supply then merely corresponds to the instant position of the first control valve.

In order to be able to determine and program the flow amount through the control valves, each control valve is provided with a position transmitter, with which the instant valve opening or flow amount, respectively, can be set.

Preferably, the valve arrangement comprises at least one electronic device for controlling the flow controlling the control valves. The device receives the individual actual pressures from the pressure sensors, particularly the pressure sensors measuring the pressures at the working connections. These actual pressures are compared with the preset desired pressures. On the basis of this comparison, a correction factor for the valve opening is determined, which is passed on to a regulating unit connected with the valve to be controlled.

In order to simplify the complete design, the valve arrangement is expediently assembled in one or more valve blocks.

Preferably, the hydraulic motor is a rotation motor or a translation motor.

BRIEF DESCRIPTION OF THE DRAWINGS

In the following, embodiments of the invention are explained in detail on the basis of the enclosed drawings, showing.

DETAILED DESCRIPTION OF THE PREFERRED EMBODIMENTS

Figure 1:
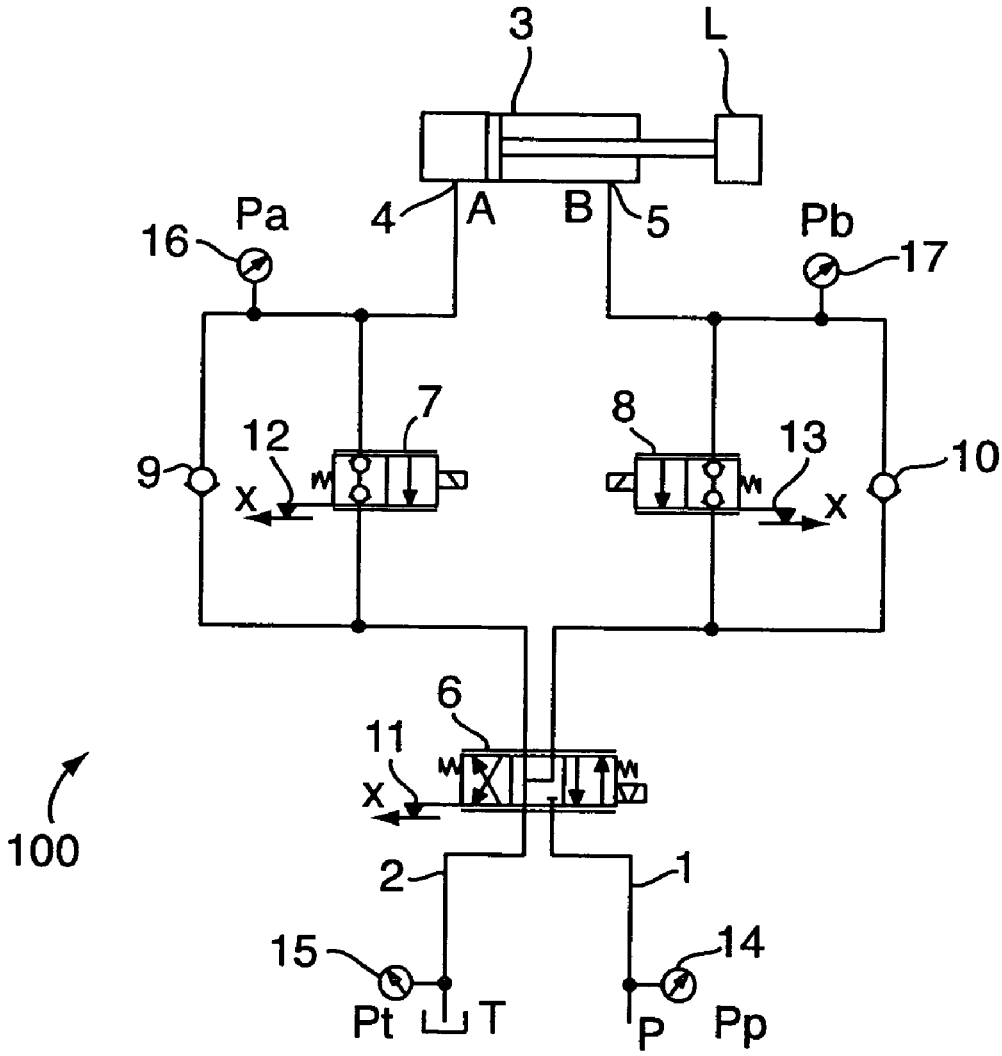
FIG. 1 is a schematic view of a first embodiment of a valve arrangement

FIG. 1 shows a valve arrangement 100. It comprises a pump pipe 1, a tank pipe 2 and a hydraulic drive 3, which is provided with the working connection 4 and 5. A first throttleable control valve 6 controls the flow amount from the pump pipe 1 to one of the working connections 4 or 5. The first control valve 6 also provides a return path from the working connections 4 and 5 to a tank T. A second throttleable control valve 7 and a third throttleable control valve 8 control the outflow amount leaving the hydraulic drive 3 through the working connections 4 and 5. The second control valve 7 and the third control valve 8 control the outflow amount from the hydraulic drive 3 in dependence of the movement direction of the hydraulic drive 3. A position transmitter 11 is located at the first control valve 6. Position transmitters 12 and 13 are located at the third control valve 7 and the third control valve 8. A pressure sensor 14 measures the hydraulic pressure in the pump pipe 1 and a pressure sensor 15 measures the hydraulic pressure in the tank pipe 2. A pressure sensor 16 measures the hydraulic pressure at the working connection 4 and a pressure sensor 17 measures the hydraulic pressure at the working connection 5. A first non-return valve 9 is connected in parallel with the second control valve 7 and a second non-return valve 10 is connected in parallel with the third control valve 8.

Figure 2:
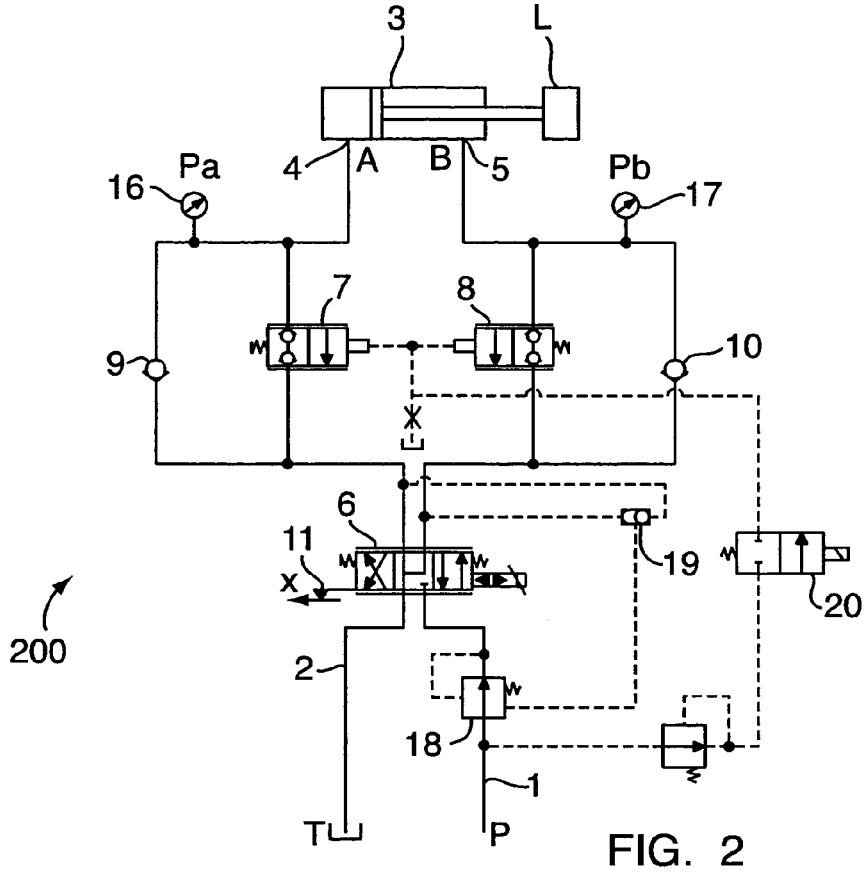
FIG. 2 is a schematic view of a second embodiment of a valve arrangement

Alternatively to the two pressure sensors 14 and 15, a valve arrangement 200 (FIG. 2) may comprise a pressure compensator 18 and a shuttle valve 19, the pressure compensator 18 being integrated in the pump pipe 1, and the shuttle valve 19 being connected with the pipe section between the first control valve 6 and the second control valve 7, with the pipe section between the first control valve 6 and the third control valve 8 and with the pressure compensator 18. Thus, the supply to the hydraulic drive 3 is controlled independently of the individual pressures in the pump pipe 1. The supply results exclusively from the instant position of the control valve 6. The shuttle valve 19 returns the pressure from the supply pipe to the pressure compensator 18. The control valves 7 and 8 are controlled by a solenoid valve 20, which can, for example, be acted upon by a pulse-width modulation. In general, it should be noted here, that more, but also less, sensors than shown might be available. The kind and number of sensors depend on the application of the system.

Figure 3:
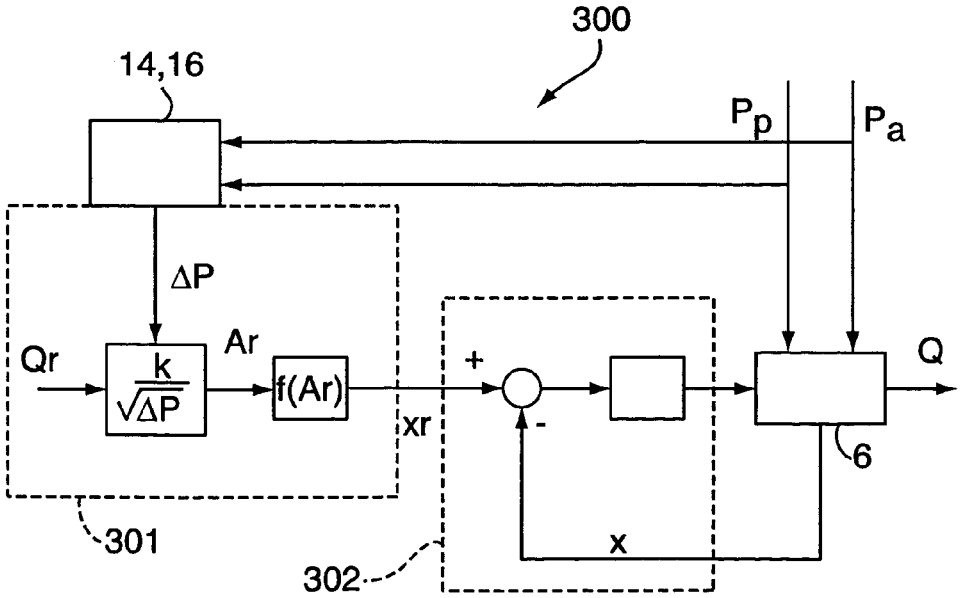
FIG. 3 is a schematic view of an electronic device for controlling a flow

FIG. 3 shows a device 300 for measuring and controlling the flow, particularly for controlling the control valve 6. Pressure sensors 14 and 16 measure the instant actual pressure and pass it on to a calculating unit 301, which calculates a pressure difference from the actual pressures. Together with a preset desired value Q for the flow and a valve constant k, the resulting pressure difference is used for determining a desired valve opening A and thus, a desired valve position $x_v$. Subsequently, the calculated values are passed on to a regulating unit 302, which sets the control valve 6, and, if required, the valves 7 and 8, at the corrected value for the flow amount.

With the described valve arrangements 100 and 200 and the device 300 a large number of different operation modes are possible, which will be explained in detail in the following. When the hydraulic fluid flows from P to B and from A to T, the hydraulic fluid flows into the hydraulic drive 3 at the working connection 5 and leaves at the working connection 4. Thus, in a first control variant, the outflow amount and the supply pressure can be controlled, the control valve 7 controlling the speed of the hydraulic drive 3 and the control valve 6 controlling the supply pressure. The desired value for the opening of the control valve 7 is determined by means of the pressures ruling at the working connection 4 and in the tank pipe 2 and by means of the desired flow through the control valve 7 or by means of the desired speed of the hydraulic drive 3 according to the circuit diagram in FIG. 3. When a load L acts opposite to the movement direction, the opening of the control valve 6 is determined by means of the desired pressure and by means of the actual pressure at the working connection 4. Alternatively, it is also possible that the opening of the control valve 6 is determined by means of the desired pressures and by means of the measured actual pressures at the working connections 4 and 5. When the load direction and the movement direction of the hydraulic drive are equal, the opening of the control valve 6 is determined by means of the desired pressure and by means of the measured actual pressure at the working connection 5. Alternatively, it is also possible to determine the opening of the control valve 6 by means of the desired pressures and by means of the measured actual pressures at the working connections 4 and 5.

In a second control variant, the supply amount and the outflow pressure are controlled. Here, the speed of the hydraulic drive 3 is controlled by the control valve 6 and the outflow pressure by the control valve 7. The desired value for the opening of the control valve 6 is calculated by means of the pressures ruling at the working connection 5 and in the pump pipe 1 and by means of the desired flow amount through the control valve 6 or by means of the desired speed of the hydraulic drive 3. This calculation takes place according to the calculation method shown in FIG. 3. Both in opposite and identical load and movement positions, the opening of the control valve 7 is determined by means of the desired pressure and by means of the measured actual pressure at the working connection 5.

Further to the described operation mode of the valve arrangements 100 and 200 from P to B and from A to T, the valve arrangements 100 and 200 can alternatively be controlled in the same manner from P to A and B to T.

In a further operation mode of the valve arrangements 100 and 200, with non-activated pump P by the load L, for example during the lowering of a load on a crane, the hydraulic drive 3 can be controlled by the control valves 7 and 8. The control valve 6 in its non-activated resting position connects the control valves 7 and 8 with each other and also with the tank pipe 2. Thus, a share of the outflow amount at the working connection 4 can be led back to the working connection 5. The speed of the hydraulic drive 3 is controlled by the control valve 7, the control valve 8 remaining closed or performing a throttling function. The second working connection 5 is additionally supplied from the tank pipe 2 via the non-return valve 10. In this operation mode, the desired value for the opening of the control valve 7 is determined by means of the calculation method according to FIG. 3.

When returning the hydraulic fluid from the working connection 5 to the working connection 4, the speed is controlled by the control valve 8, the control valve 7 remaining closed or performing a throttling function.

Alternatively to the above described returning of hydraulic fluid from one working connection to the other by means of a load L acting upon the drive from the outside, the hydraulic drive 3 can, for example, be driven by a load L hanging on the hook, so that the hydraulic fluid is supplied to the hydraulic drive at the working connection 4. Such a situation occurs, for example, when using a tractor, preferably, when the "hook" is formed by the toolbar of the tractor. The hydraulic drive is connected as shown in FIG. 1. The throttleable control valve 8 serves as relief valve for the second working connection 5. The first working connection 4 is supplied from the tank pipe 2 through the non-return valve 9. Alternatively, however, the first working connection 4 can also be supplied with hydraulic fluid via the control valve 6, which is in its resting position. When the pressure in the second working connection 5 drops below a limit value, the hydraulic drive 3 moves in the opposite direction, the hydraulic fluid either flowing from P to B and from A to T, the pressure at the working connection being at the same time kept low, or the hydraulic fluid being led from the working connection 5 back to the working connection 4.

In a further operation mode of the valve arrangements 100 and 200, it is also possible that the control valve 6, when in the non-activated resting position, connects the two hydraulic pipes between the control valve 6 and the control valves 7 and 8 with the tank pipe 2. When the control valves 7 and 8 are completely opened, the hydraulic fluid can be pressed in an unthrottled manner through the hydraulic pipes by a load L on the hydraulic drive 3.

When, in another operation mode, the control valves 7 and 8 are closed and the control valve 6 is in its resting position, the hydraulic drive 3 can, together with the non-return valves 9 and 10, be kept in its instant position without causing undesired leakage flows at the working connections 4 and 5.

What is claimed is:

1. A valve arrangement for controlling a hydraulic drive, the supply and the outflow of the hydraulic drive being separately controllable, the valve arrangement comprising:

a pump pipe;

a tank pipe;

a first control valve connected with the pump pipe and the tank pipe;

a second control valve connected with the first control valve;

a third control valve connected with the first control valve;

a first working connection of the hydraulic drive connected with the second control valve;

a second working connection of the hydraulic drive connected with the third control valve;

at least one backflow preventer for preventing flow from the hydraulic drive in the direction of the tank pipe, the at least one backflow preventer being connected in parallel with one of the second control valve and the third control valve; and at least one electronic device for controlling the control valves;

wherein the electronic device is adapted to operate the valve arrangement in at least one of the following modes by controlling the control valves:

a control of supply pressure and outflow amount mode;

a control of supply amount and outflow pressure mode; and a controlled returning of hydraulic fluid from one working connection to the other working connection mode.

2. The valve arrangement according to claim 1, wherein the at least one backflow preventer is integrated in one of the second control valve and the third control valve.

3. The valve arrangement according to claim 1, wherein the supply to the hydraulic drive is controllable by the first control valve and the outflow from the hydraulic drive is controllable by the second control valve or the third control valve.

4. The valve arrangement according to claim 1, wherein the first control valve is a 4/3-way valve, through which a connection of the pump pipe and the tank pipe with the two working connections, a connection of the second control valve with the third control valve and a connection of both the second control valve and the third control valve with the tank pipe is realised.

5. The valve arrangement according to claim 4, wherein the first control valve and/or the second control valve and/or the third control valve are adjustable directly and/or through a pressure control and/or through a directional control and/or through a pulse-width modulated control valve.

6. The valve arrangement according to claim 4, wherein a magnet and a spring are driving each control valve.

7. The valve arrangement according to claim 1, wherein in the resting position of the first control valve, the connection of the second control valve with the third control valve and the connection of both the second control valve and the third control valve with the tank pipe are ensured.

8. The valve arrangement according to claim 1, wherein the second control valve and the third control valve can be activated separately or in common.

9. The valve arrangement according to claim 1, wherein the valve arrangement has a first pressure sensor in the pump pipe, a second pressure sensor in the tank pipe, a third pressure sensor for measuring the pressure at the first working connection and a fourth pressure sensor for measuring the pressure at the second working connection.

10. The valve arrangement according to claim 1, wherein the valve arrangement further comprises a mechanical pressure compensator and a shuttle valve, the mechanical pressure compensator being integrated in the pump pipe and the shuffle valve being connected with the pipe section between the first control valve and the second control valve, with the pipe section between the first control valve and the third control valve and with the mechanical pressure compensator.

11. The valve arrangement according to claim 1, wherein each control valve is provided with a position transmitter.

12. The valve arrangement according to claim 1, wherein the valve arrangement is assembled in one or more valve blocks.

13. The valve arrangement according to claim 1, wherein the hydraulic drive is a rotation motor or a translation motor.

14. A valve arrangement for controlling a hydraulic drive, the supply and the outflow of the hydraulic drive being separately controllable, the valve arrangement comprising:

a pump pipe;

a tank pipe;

a first control valve connected with the pump pipe and the tank pipe;

a second control valve connected with the first control valve;

a third control valve connected with the first control valve;

a first working connection of the hydraulic drive connected with the second control valve;

a second working connection of the hydraulic drive connected with the third control valve;

at least one backflow preventer for preventing flow from the hydraulic drive in the direction of the tank pipe, the at least one backflow preventer being connected in parallel with one of the second control valves and the third control valve; and at least one electronic device for controlling the control valves;

wherein the electronic device is adapted to operate the valve arrangement in at least one of the following modes by controlling the control valves;

a control of supply pressure and outflow amount mode;

a control of supply amount and outflow pressure mode; and a controlled returning of hydraulic fluid from one working connection to the other working connection mode; and wherein the second control valve and the third control valve are 2/2-way valves, through which the outflow of the hydraulic drive is controlled.

15. A valve arrangement for controlling a hydraulic drive, the supply and the outflow of the hydraulic drive being separately controllable, the valve arrangement comprising:

a pump pipe;

a tank pipe;

a first control valve connected with the pump pipe and the tank pipe;

a second control valve connected with the first control valve;

a third control valve connected with the first control valve;

a first working connection of the hydraulic drive connected with the second control valve;

a second working connection of the hydraulic drive connected with the third control valve;

at least one backflow preventer for preventing flow from the hydraulic drive in the direction of the tank pipe, the at least one backflow preventer being connected in parallel with one of the second control valve and the third control valve; and at least one electronic device for controlling the control valves;

wherein the electronic device is adapted to a operate the valve arrangement in at least one of the following modes by controlling the control valves;

a control of supply pressure and outflow amount mode;

a control of supply amount and outflow pressure mode; and a controlled returning of hydraulic fluid from one working connection to the other working connection mode; and wherein in the resting position of the second and the third control valves the outflow of the hydraulic drive is blocked.

* * * * *